US005433182A

United States Patent [19]

Augustin et al.

[11] Patent Number: 5,433,182

[45] Date of Patent: Jul. 18, 1995

[54] FUEL INJECTION SYSTEM FOR A MULTI-CYLINDER DIESEL ENGINE

[75] Inventors: Ulrich Augustin, Kernen; Volker Schwarz, Weinstadt; Hermann Hiereth, Esslingen, all of Germany

[73] Assignee: Mercedes-Benz A.G., Stuttgart, Germany

[21] Appl. No.: 322,938

[22] Filed: Oct. 13, 1994

[30] Foreign Application Priority Data

Oct. 15, 1993 [DE] Germany ..... 43 35 171.9

[51] Int. Cl.[6] ..... F02M 41/00

[52] U.S. Cl. ..... 123/456; 123/198 F; 123/198 DB

[58] Field of Search ..... 123/456, 198 D, 198 DB, 123/198 F, 497, 467, 494

[56] References Cited

U.S. PATENT DOCUMENTS

| | | | |
|---|---|---|---|
| 3,431,900 | 7/1969 | Jackson | 123/456 |
| 4,492,191 | 1/1985 | Aoki | 123/198 F |
| 5,042,445 | 8/1991 | Peters | 123/446 |
| 5,076,227 | 12/1991 | Krieger | 123/198 DB |
| 5,168,855 | 12/1992 | Stone | 123/456 |
| 5,207,203 | 5/1993 | Wagner | 123/456 |
| 5,215,084 | 5/1993 | Linder | 123/456 |
| 5,230,613 | 7/1993 | Hilbos | 123/456 |
| 5,357,929 | 10/1994 | McCandless | 123/446 |

FOREIGN PATENT DOCUMENTS

| | | |
|---|---|---|
| 0501459 | 9/1992 | European Pat. Off. . |
| 0531533 | 3/1993 | European Pat. Off. . |
| 4030490 | 4/1991 | Germany . |
| 4104791 | 8/1992 | Germany . |
| 4233273 | 9/1993 | Germany . |

*Primary Examiner*—Carl S. Miller
*Attorney, Agent, or Firm*—Klaus J. Bach

[57] ABSTRACT

In a fuel injection system for a multi-cylinder Diesel engine which is provided with magnetic valve-controlled fuel injection nozzles, and which has two fuel supply conduits (common rails) for two different groups of fuel injection nozzles and at least one high-pressure pump connected to the fuel supply conduits for delivering high-pressure fuel thereto, each fuel supply conduit includes a pressure sensor which is connected to means for shutting off the fuel supply to a fuel supply conduit when the sensor senses a pressure loss in that conduit so that the pressure can be maintained in the other fuel supply conduit and the engine can be operated on a limited basis by the cylinders supplied by the groups of injection nozzles supplied with fuel by the other fuel supply conduit.

6 Claims, 2 Drawing Sheets

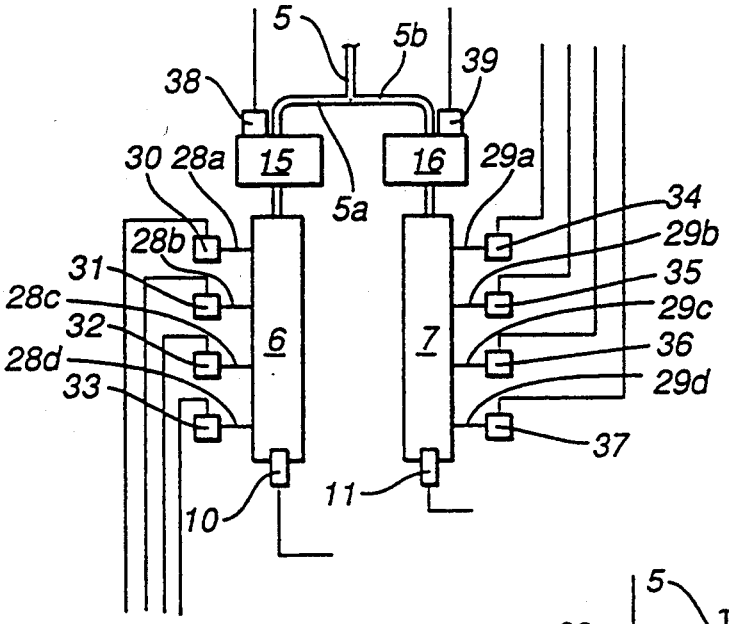
Fig. 3
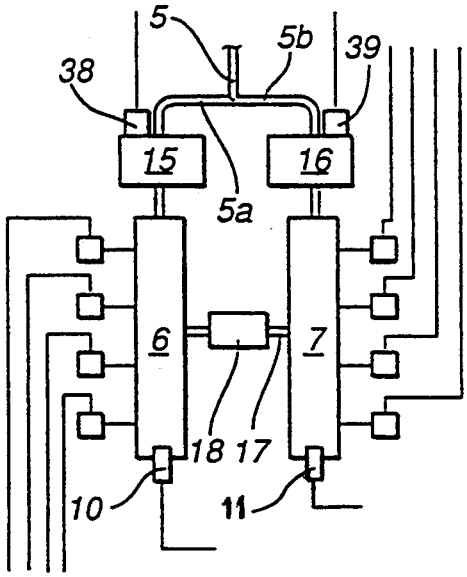
Fig. 4
Fig. 5
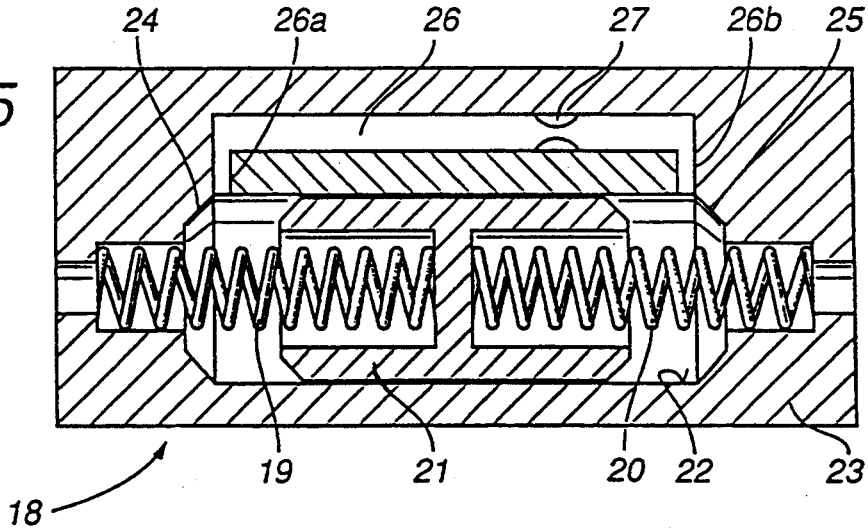

FUEL INJECTION SYSTEM FOR A MULTI-CYLINDER DIESEL ENGINE

BACKGROUND OF THE INVENTION

The invention relates to a fuel injection system for a multi-cylinder Diesel internal combustion engine with separate common fuel supply lines for at least two groups of cylinders from which high-pressure fuel is supplied to the injectors of the cylinders in a group.

A fuel injection system is known, for example, from EP 05 01 459 A2, in which a mechanically driven high-pressure pump delivers fuel into a common supply conduit (common rail) from which individual injection conduits lead to magnetic valve-controlled injection nozzles.

DOS 42 33 273 A1 discloses a fuel injection system with two high-pressure fuel supply conduits for different groups of cylinders with provisions for returning the leakage fuel to the pump rather than the fuel tank in order to decrease the fuel pumping requirements.

In the case of a defect of an injection nozzle due to leakage or in the case of a fault in a magnetic valve which keeps such valve open, the supply conduit pressure necessary for satisfactory fuel injection falls so that satisfactory operation of the internal combustion engine is no longer warranted; in fact, the internal combustion engine may be destroyed in such an event.

The object of the invention is, therefore, to provide measures by which safe emergency operation of the multi-cylinder internal combustion engine can still be maintained when such a fault occurs.

SUMMARY OF THE INVENTION

In a fuel injection system for a multi-cylinder Diesel engine which is provided with magnetic valve-controlled fuel injection nozzles, and which has two fuel supply ducts (common rails) for two different groups of fuel injection nozzles and at least one high-pressure pump connected to the fuel supply ducts for delivering high-pressure fuel thereto, each fuel supply duct includes a pressure sensor which is connected to means for shutting off the fuel supply to a fuel supply duct when the sensor senses a pressure loss in that duct so that the pressure can be maintained in the other fuel supply duct and the engine can be operated on a limited basis by the cylinders supplied by the groups of injection nozzles supplied with fuel by the other fuel supply duct.

Since the cylinders are divided into two groups and one common supply conduit is provided for each group of cylinders, one supply conduit can be taken out of service by switching off the high-pressure fuel supply upon the occurrence of a fault while the other fault-free supply conduit can continue to be supplied with high-pressure fuel so as to ensure at least emergency operation of the internal combustion engine.

Advantageous and expedient further features of the invention are apparent from the following description of preferred embodiments.

BRIEF DESCRIPTION OF THE DRAWINGS

FIG. 3 shows a fuel injection system with two high-pressure pumps which can be switched off;

FIG. 4 shows a fuel injection system with two high-pressure pumps which can be switched off and a pressure balancing conduit between common supply conduits; and FIG. 5 shows, in an enlarged representation, a spool valve as disposed in the pressure balancing conduit.

DESCRIPTION OF PREFERRED EMBODIMENTS

Figure 1:
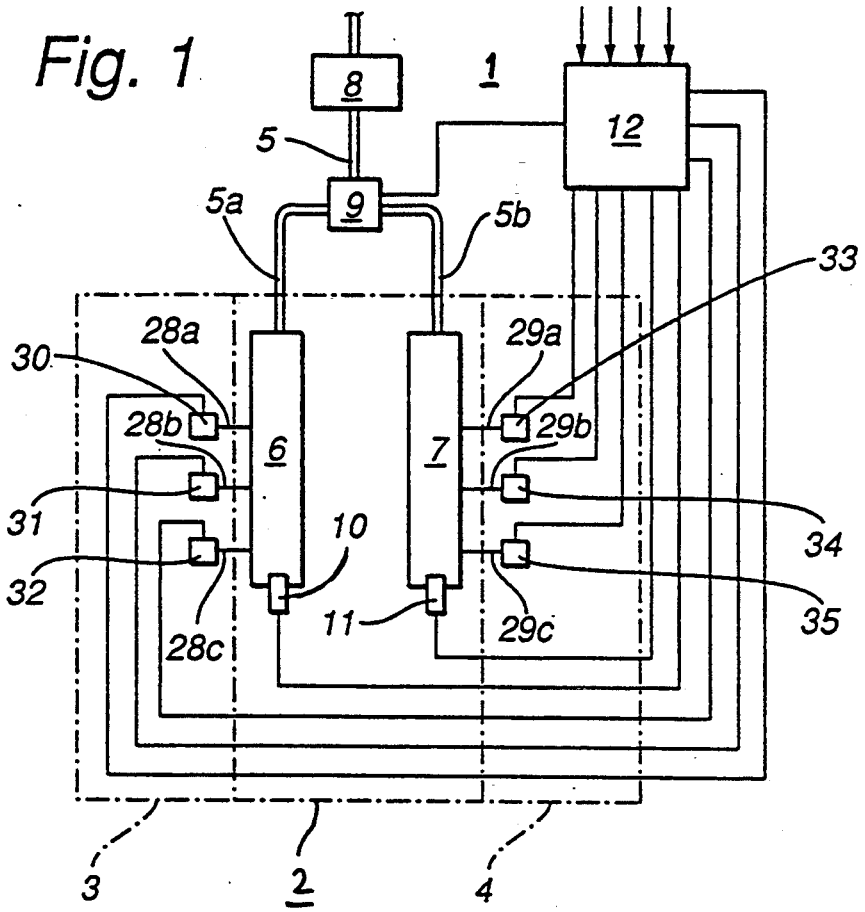
FIG. 1 shows a fuel injection system with one high-pressure pump and one valve in a delivery line leading to two common supply conduits.

A fuel injection system 1 with high-pressure storage for a six-cylinder or multi-cylinder Diesel internal combustion engine 2 with cylinder banks 3, 4 includes a supply conduit 5 and, subdivided in fork fashion, two conduit sections **5*a*, 5*b* of which one conduit section 5*a* provides for communication with a common fuel supply conduit 6 allocated to the cylinder bank 3 and the other conduit section 5*b* provides for communication with another common fuel supply conduit 7 allocated to the cylinder bank 4, the engine and the cylinder banks being indicated in FIG. 1** schematically by dash-dotted lines.

A mechanically driven high-pressure pump 8 is arranged in the supply conduit 5 of FIG. 1 which also includes a valve 9, by means of which fuel is delivered to both the one and the other common supply conduit 6, 7 during normal operation of the internal combustion engine, the valve being arranged in the fork to control the fuel supply to both supply conduits 6 and 7. Each of the fuel supply conduits 6 and 7 includes a pressure sensor 10, 11 which are both connected to an electronic control unit 12. As soon as a fault occurs in one of the fuel supply conduits 6, 7, that is, when a pressure drop is sensed by a pressure sensor, the pressure signal which is supplied to the electronic control unit 12 causes a switch-over of the valve 9 in such a way that only the fault-free fuel supply conduit is supplied with high-pressure fuel whereas the fuel supply to the other is cut off. The valve 9 could, for example, be a spool valve with three switching positions, of which the switching position for fault-free operation provides for high-pressure fuel supply from the high-pressure pump 8 to both common supply conduits 6, 7 and the second or third switching positions are for faulty operation wherein a communication path is provided for the high-pressure fuel supply from the high-pressure pump 8 to only one of the common fuel supply conduits whereas the high-pressure fuel supply to the leaking common fuel supply conduit is shut off.

Figure 2:
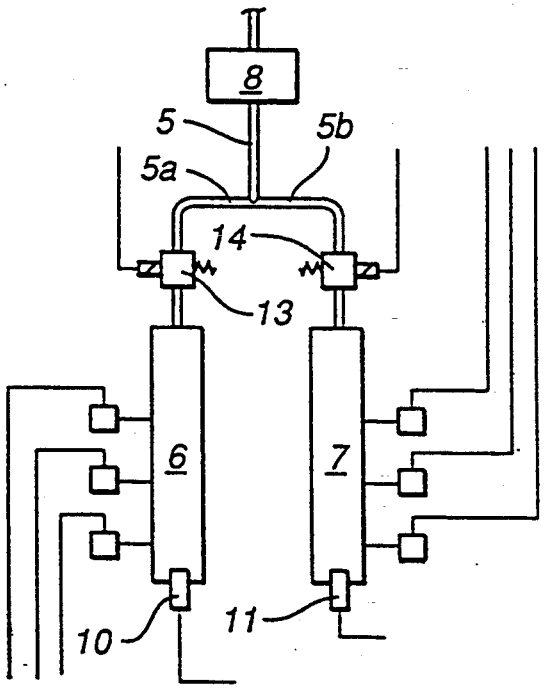
FIG. 2 shows a fuel injection system with one high-pressure pump and two valves.

In the embodiment shown in FIG. 2 which also has only one high-pressure pump 8, the valve 9 in the fork is replaced by two magnetic valves 13, 14 which can be controlled by the control unit 12. Of these magnetic valves, the magnetic valve 13 is disposed in the conduit section **5*a* leading to the fuel supply conduit 6 and the magnetic valve 14 is disposed in the conduit section 5*b* leading to the fuel supply conduit 7**.

In the embodiment of FIG. 3 each conduit section **5*a*, 5*b* is provided with a magnetic valve-controlled high-pressure pump 15, 16 which delivers fuel into the associated common fuel supply conduit 6, 7. Downstream of the high-pressure pumps 15, 16 the two supply conduits 6, 7 are, like in the embodiments shown in FIGS. 1 and 2, independent of one another and each has a pressure sensor 10, 11 for sensing a pressure loss in the respective one of the supply conduits 6, 7**.

In the embodiment shown in FIG. 4, a pressure balancing conduit 17, with an intermediate shut-off valve 18, connects the two fuel supply conduits 6, 7. The shut-off valve 18 may be an electromagnetic 2-way valve (not represented) or a pressure-balanced spool valve (FIG. 5). In this case, only one of the supply conduits 6 or 7 needs to be provided with a pressure sensor 10 or 11.

The spool valve 18 consists of a valve housing 23 with a spool 21 movable between opposite end positions in which fuel flow between the fuel supply conduits 6 and 7 in either direction is blocked. The spool is normally held in its central position by springs 19, 20 and is guided so that it can be easily displaced longitudinally between the two end positions which are defined by conical valve seats 24, 25, in a cylindrical cavity 22 of a multi-step configuration. The valve housing 23 includes a by-pass conduit 26 with conduit ends 26*a*, 26*b* which open into the cylindrical cavity 22 near the valve seats in such a way that the by-pass conduit 26 can be shut off, and the connection between the two common supply conduits 6, 7 interrupted, in both end positions. The by-pass conduit 26 further has a throttle structure 27 or is small enough to be throttling to prevent large fuel flows therethrough.

The pressure balancing conduit 17 with the throttle structure 27 serves to balance pressure in the case of an imbalance in the high-pressure delivery of the two high-pressure pumps 15, 16. The throttled conduit prevents the spool 21 from moving into an end position and remaining there in the case of a slight extra delivery from one high-pressure pump.

However, should the pressure drop in one of the common supply conduits 6, 7 be relatively large, for example, due to a fault or a leak or because of jamming of the nozzle needle or a malfunctioning of a magnetic nozzle valve, and one supply conduit is switched off by not supplying fuel thereto, the spool 21 interrupts the connection between the supply conduits 6, 7 so that emergency operation of the engine via the operative fuel supply conduit is possible.

In FIGS. 1 to 4, the injection conduits extending from the supply conduits 6, 7 to the engine injectors are additionally designated by numerals 28*a*, 28*b*, 28*c*, 28*d* and by 29*a*, 29*b*, 29*c*, 29*d* and the injection nozzles to which they are connected are designed by numerals 30 to 35 for the six-cylinder engine (FIG. 2) and 30 to 37 for the eight-cylinder engine (FIG. 3).

The high-pressure pumps 15, 16 used are provided with pressure-balanced magnetic valves 38, 39 which are usually intended for timing the beginning of injection and the duration of injection but which in the present case have the additional duty of shutting down a faulty fuel supply conduit by switching off the corresponding magnetic valve.

What is claimed is:

1. A fuel injection system for a multi-cylinder Diesel engine provided with magnetic valve-controlled fuel injection nozzles, said system comprising at least two fuel supply conduits, one for supplying pressurized fuel to some of said fuel injection nozzles and the other for supplying fuel to the other of said fuel injection nozzles, at least one high-pressure fuel pump connected to said fuel supply conduits for delivering thereto fuel under pressure, means for controlling the supply of fuel to said fuel supply conduits and pressure sensors arranged so as to sense the fuel pressure in each of said fuel supply conduits and connected to means for operating said fuel supply control means, said means for operating said fuel supply control means being adapted to interrupt the supply of fuel to a particular fuel supply conduit when the respective sensor senses a pressure loss in the particular fuel supply conduit.

2. A fuel injection system according to claim 1, wherein a single high-pressure pump is provided for supplying high-pressure fuel to two fuel supply conduits through two branch conduits and a shut-off valve is provided for supplying fuel from said high-pressure pump to either both of said branch conduits or only one of said branch conduits while shutting off the fuel supply to the other.

3. A fuel injection system according to claim 1, wherein a single high-pressure pump is provided for supplying high-pressure fuel to said fuel supply conduits through branch conduits interconnecting said high-pressure pump with said fuel supply conduits and an electromagnetically actuable shut-off valve is disposed in each branch conduit for interrupting the fuel supply to the respective fuel supply conduit.

4. A fuel injection system according to claim 1, wherein a separate high-pressure pump is provided for each of said fuel supply conduits and means are provided for disabling a selected pump for interrupting the fuel supply to the fuel supply conduit served by said selected pump.

5. A fuel injection system according to claim 4, wherein a pressure balancing conduit extends between said fuel supply conduits for equalizing the pressures therein, said pressure balancing conduit including a shut-off valve adapted to interrupt the communication between the two fuel supply conduit when a loss of fuel pressure is sensed in one of said fuel supply conduits thereby preventing loss of fuel from the other fuel conduit.

6. A fuel injection system according to claim 5, wherein said shut-off valve is a spool valve having a spool disposed in a cylindrical cavity so as to be movable between two end positions in each of which communication between said two fuel supply conduits is interrupted by said spool, said spool being held in an intermediate position by springs but being movable to an end position by a loss of pressure in one of said fuel supply conduits thereby preventing loss of pressurized fuel from the other fuel supply conduit.

* * * * *